US011064742B2

(12) United States Patent
Amrikhas

(10) Patent No.: US 11,064,742 B2
(45) Date of Patent: Jul. 20, 2021

(54) CONVERTIBLE BIB

(71) Applicant: MUNCHKIN, INC., Van Nuys, CA (US)

(72) Inventor: Caroline Amrikhas, San Jose, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 14/201,710

(22) Filed: Mar. 7, 2014

(65) Prior Publication Data

US 2014/0250557 A1 Sep. 11, 2014

Related U.S. Application Data

(60) Provisional application No. 61/775,425, filed on Mar. 8, 2013.

(51) Int. Cl.
*A41B 13/10* (2006.01)

(52) U.S. Cl.
CPC ..... *A41B 13/103* (2013.01); *A41B 13/106* (2013.01)

(58) Field of Classification Search
CPC .. A41D 13/04; A41D 15/04; A41D 2400/422; A41B 13/103; A41B 13/106; A41B 13/10
USPC ..... 2/49.1, 49.2, 49.3
See application file for complete search history.

(56) References Cited

U.S. PATENT DOCUMENTS 1,797,208 A * 3/1931 Weisz ..... 2/51
2,389,596 A * 11/1945 Charnas et al. ..... 224/623
3,407,407 A * 10/1968 Hollander ..... A41B 13/103 2/49.2
4,710,979 A * 12/1987 Bull et al. ..... 2/48
5,201,073 A * 4/1993 Spanier ..... 2/49.2
5,244,278 A * 9/1993 Robitaille ..... 383/4
5,483,701 A * 1/1996 Ferreyros ..... 2/49.2
5,509,141 A * 4/1996 Saltzman ..... 2/49.2
5,960,472 A * 10/1999 Reid ..... 2/48
6,105,165 A * 8/2000 Johnson et al. ..... 2/49.2
6,405,378 B1 * 6/2002 Garner ..... 2/102
D491,342 S * 6/2004 Jordan ..... D2/863
8,056,146 B2 * 11/2011 Porowski ..... 2/51
D698,130 S * 1/2014 Worden, IV ..... D2/864
D903,985 S * 12/2020 Cannon ..... D2/864
2004/0205876 A1 * 10/2004 Bruffett ..... 2/49.2
2007/0061939 A1 * 3/2007 Rose ..... A41B 13/10 2/49.1
2011/0067161 A1 * 3/2011 Perazzo ..... 2/49.3
2013/0111644 A1 * 5/2013 Timmons et al. ..... 2/48

FOREIGN PATENT DOCUMENTS

GB 2378634 A * 2/2003 ..... A41B 13/103
WO WO2008020197 * 2/2008

* cited by examiner

*Primary Examiner* — Alissa J Tompkins
*Assistant Examiner* — Brieanna Szafran
(74) *Attorney, Agent, or Firm* — Alan D. Borelli, Esq.; Robert Z. Evora, Esq.

(57) ABSTRACT

A bib having a first panel and a storage container. The first panel has a collar constructed in a first end. The storage container has a first and a second side, an upper opening and a lower closed end. The first panel also has a second end which is attached to an upper end of the second side of the storage container in order to capture spillage while the bib is in use. The first panel can also be folded down into the storage container and secured by a fastener about the upper opening of the storage container.

16 Claims, 10 Drawing Sheets

CONVERTIBLE BIB

CROSS REFERENCE TO RELATED APPLICATION

This application claims priority to U.S. Provisional Application Ser. No. 61/775,425 filed Mar. 8, 2013; the contents of all of which are hereby incorporated by reference herein in their entirety into this disclosure.

TECHNICAL FIELD

The subject disclosure relates to a bib, and in particular a combined bib and storage device.

BACKGROUND

Conventionally, an infant bib is worn hanging from the neck and extends over the chest to protect clothing from the spilling of food or drink. Traditionally, a caregiver has various items to transport when taking an infant away from the home. A few examples carried for a feeding time may include a bib, formula and snacks, etc. Because of the special needs of a young infant, a caregiver oftentimes has to carry a bag or the like to transport the various items around during the day.

Thus, there is a long-standing need to have a bib configured to address these needs.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
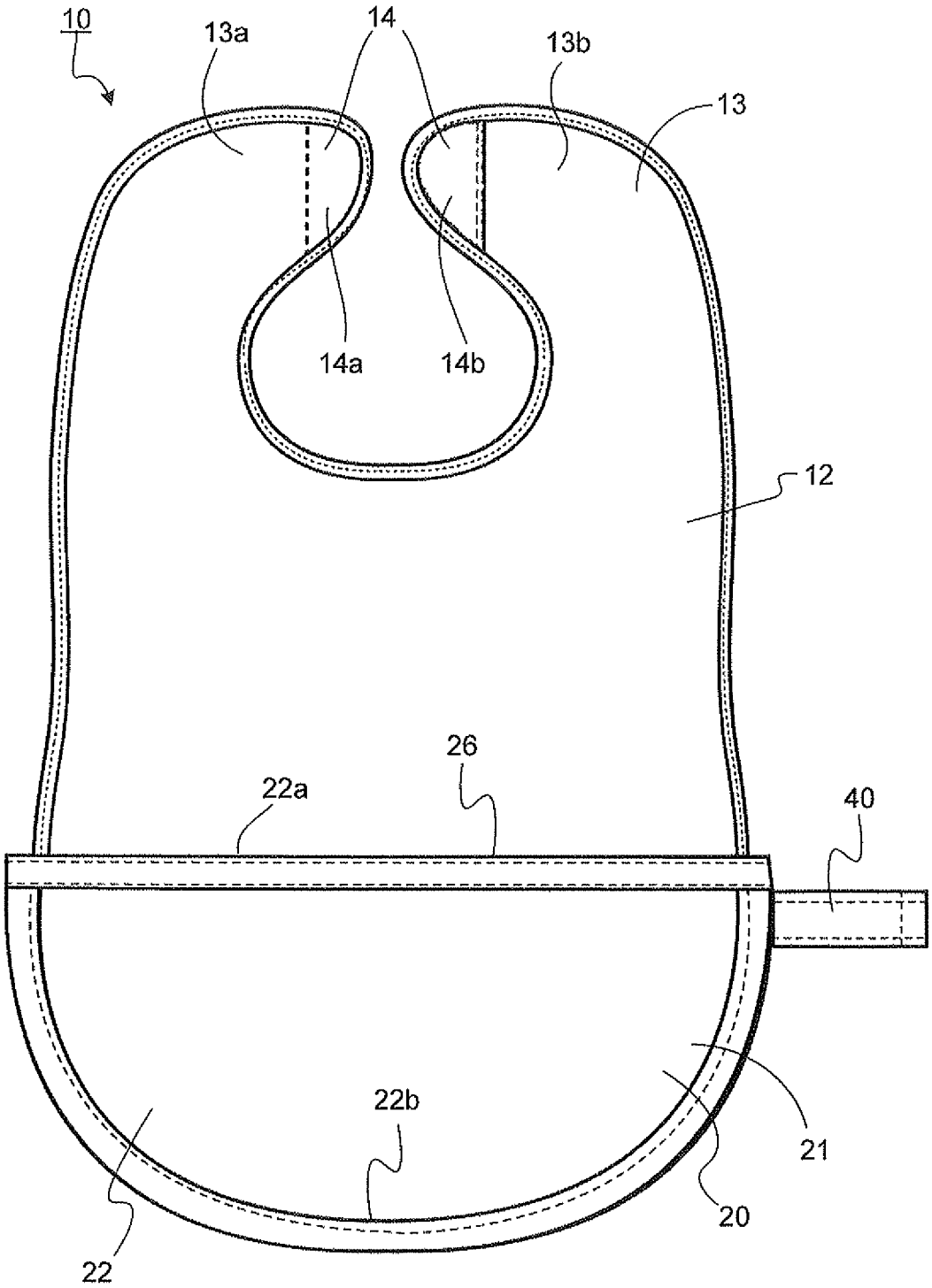
FIG. 1 shows a front view of an exemplary convertible bib according to the subject disclosure.

FIG. 1 illustrates an exemplary convertible bib 10 having a combined bib and storage container 20 with an adjustable fastener 40 attached thereto. As described in more detail later, the convertible bib 10 is foldable and can be collapsed down and stored in the storage container 20.

Various items can also be conveniently stored in the storage container 20 according to this subject disclosure. The convertible bib 10 can be portably stored in a small bag and conveniently carried by a caregiver. Various items can be secured in the storage container 20, such as, but not limited to, a spoon, travel size wet wipes, squeezable baby food containers, hand sanitizer, etc., for use while dining away from home.

The convertible bib 10 includes a first panel 12 having a collar 13 disposed at a first end adapted to extend around the neck of a user. The collar 13 may include two sub-collar portions 13*a*, 13*b* that extend around the neck of the infant and are adapted to secure the convertible bib 10 to the infant.

A first closure device 14 including at least two mating fastening portions 14*a*, 14*b* may be disposed at the top end of the collar portions 13*a*, 13*b* to connect the collar 13 around the neck of the user. The closure device 14 provides an adjustable means by which the collar portions 13*a*, 13*b* can be incrementally adjusted and secured to the first collar portion 13*a* to the second collar portion 13*b* around the neck of the wearer and to remain securely on the neck. The closure device 14 can be one or more metal snaps, plastic snaps, buttons and button holes, hook-and-loop fasteners (e.g. VELCRO®), zippers, magnets sewn into the collar with polarities arranged for magnetic attraction and closure, and/or any other suitable closure mechanism in accordance with this subject disclosure.

Figure 2:
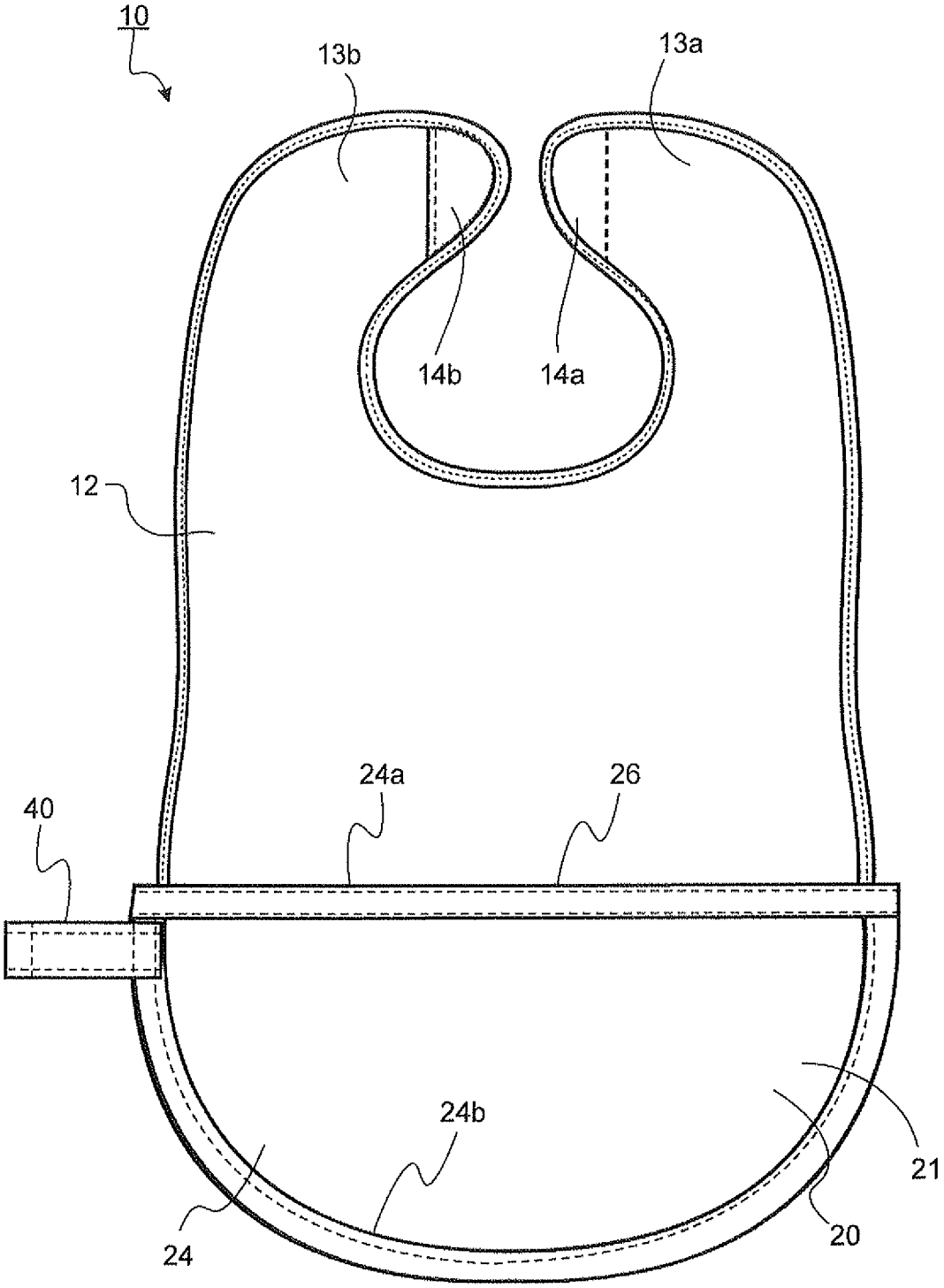
FIG. 2 shows a rear view of an exemplary convertible bib according to the subject disclosure.
Figure 3:
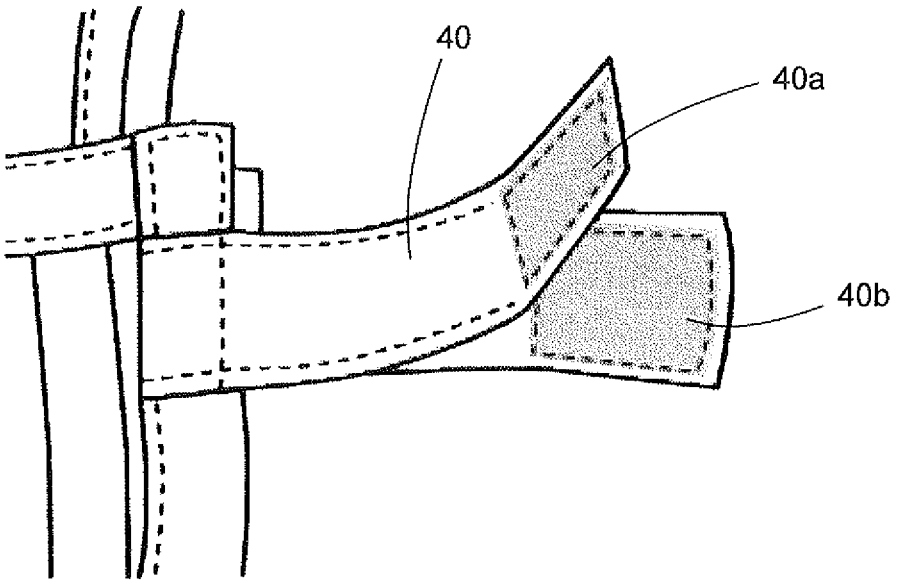
FIG. 3 shows an adjustable fastener attached to the bib.

As shown in FIG. 2, the first panel 12 extends from the collar 13 portion downward and attaches to a top edge 24*a* of a rear panel 24 in the storage container 20. The storage container 20 includes a front panel 22 and a rear panel 24.

Figure 4:
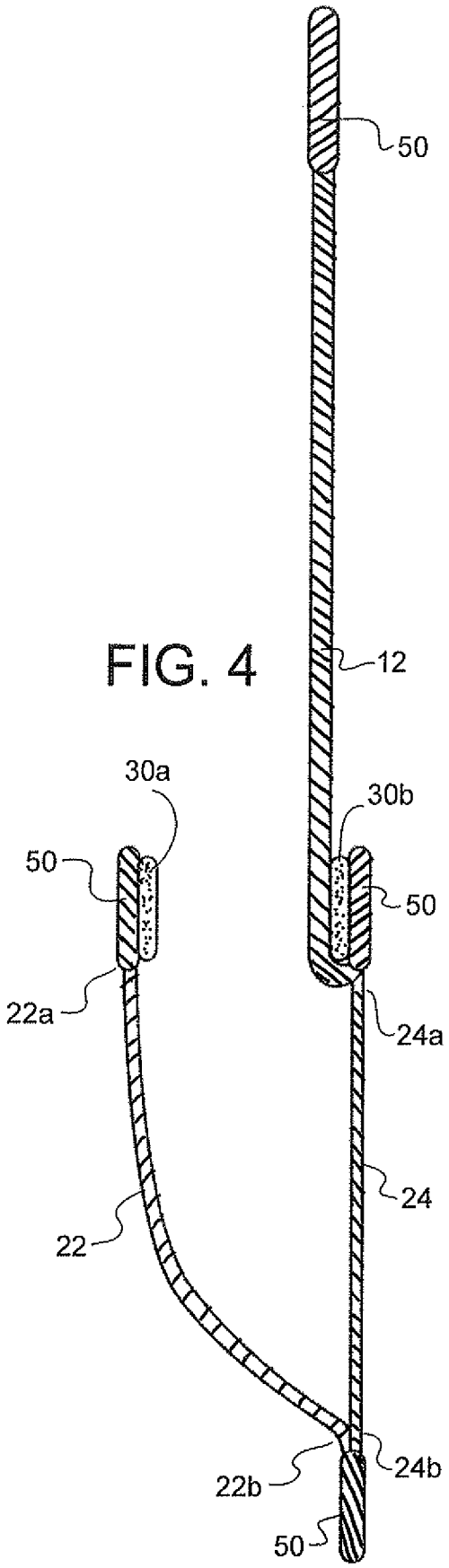
FIG. 4 depicts a full side cross section view of the bib.

Referring to FIGS. 1-2 and 4, the front panel 22 and the rear panel 24 of the storage container 20 include an unattached open mouth 26 portion. The remainder of the sides 22*b* of the front panel 22, and the remainder of the sides 24*b* of the rear panel 24 are attached to each other along their respective sides 22*b*, 24*b* and define an open pocket 21 into which various items may be stored. The pocket 21 is designed to catch various items during feeding, such as capturing food particles, liquids, and/or other items during the feeding process.

The various panels of the convertible bib 10 are comprised of a material that can be easily cleaned and washed after use. That is, the convertible bib 10 can be comprised of a polymer, fabric and/or any other suitable material according to this subject disclosure. The material of the convertible bib 10 can be protective water-repellant and stain-resistant layer. The protective water-repellant and stain-resistant layer can cover, or make up, each surface of the convertible bib 10 and/or selected surfaces of the convertible bib 10.

As shown in FIG. 4, the top edge 22*a* of the front panel of the storage container 20, and the top edge 24*a* of the rear panel 24 of the storage container 20 can include mating closure elements of a second closure device 30. A first closure element 30*a* of the second closure device 30 may be disposed on the inside of the seam disposed at the top of the front panel 22. A second closure element 30*b* of the second closure device 30 may be disposed on the inside of the seam disposed at the top of the rear panel 24. The first closure element 30*a* faces the second closure element 30*b*. When the storage container 20 is to be secured closed, the first closure element 30*a* is matingly secured to the second closure element 30*b*.

As before, the second closure device 30 can be one or more metal snaps, plastic snaps, buttons and button holes, hook-and-loop fasteners (e.g. VELCRO®), zippers, magnets sewn into the collar with polarities arranged for magnetic attraction and closure, and/or any other suitable closure mechanism in accordance with this subject disclosure.

Various seams 50 can be sewn by various stitches 60 into the edges of the bib to reinforce the edges from tear. Likewise, the edges of the bib can be folded over or built up to provide added rigidity to the edges of the bib 10.

Figure 5:
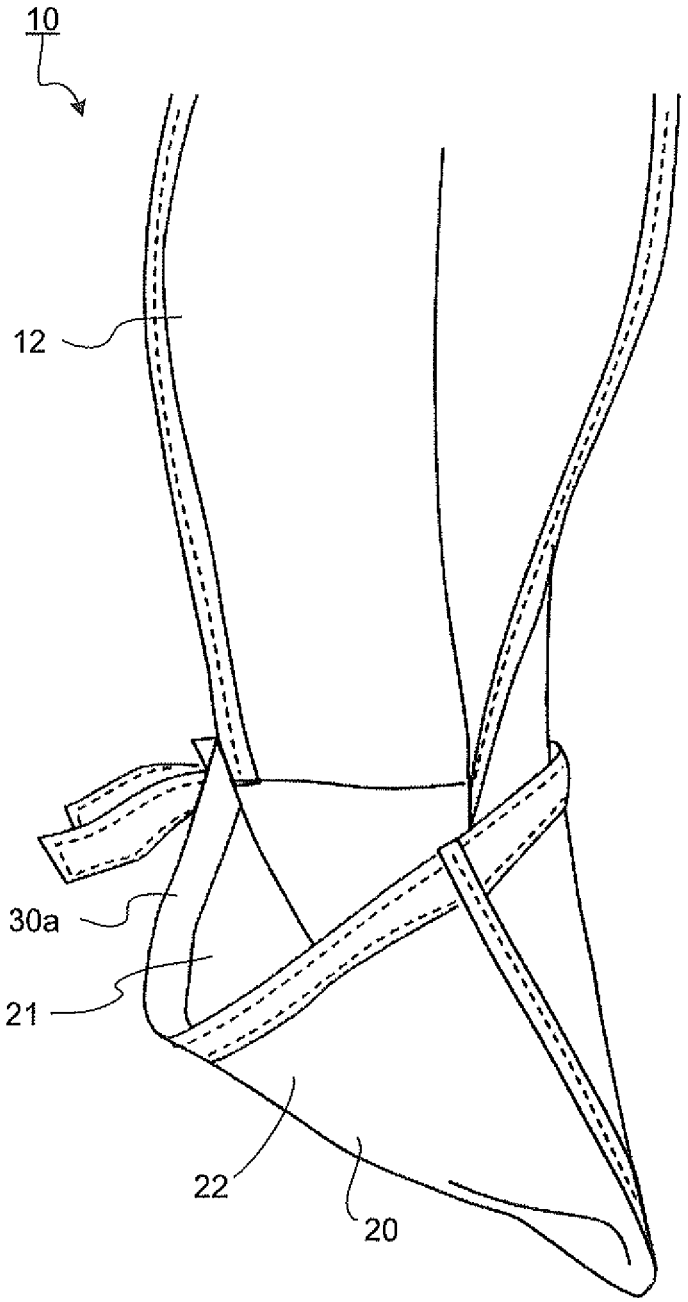
FIG. 5 illustrates the bib position in use during meal time.
Figure 6:
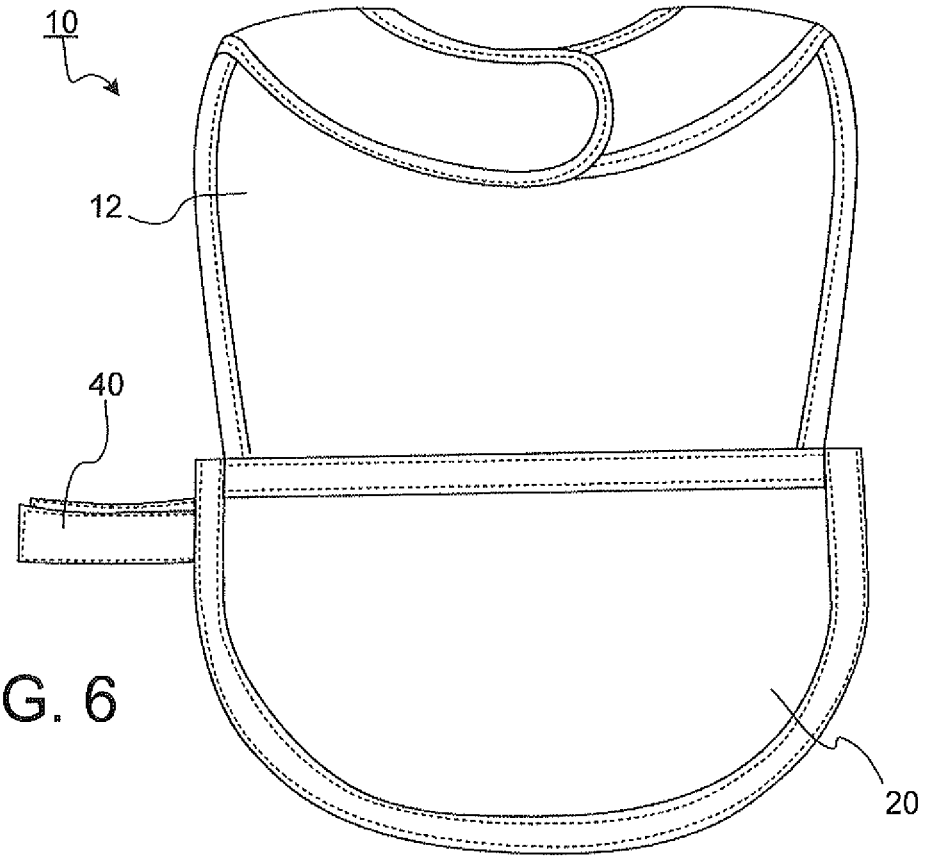
FIGS. 6-11 show the folding down and storage of the first panel of the bib.
Figure 7:
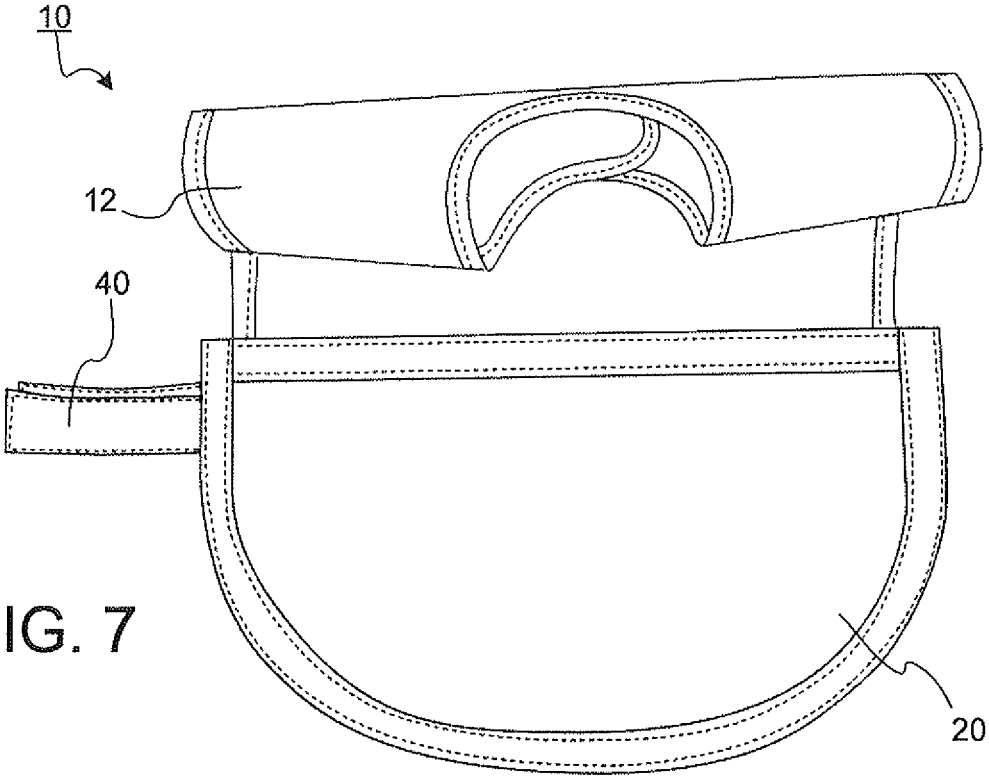
Figure 8:
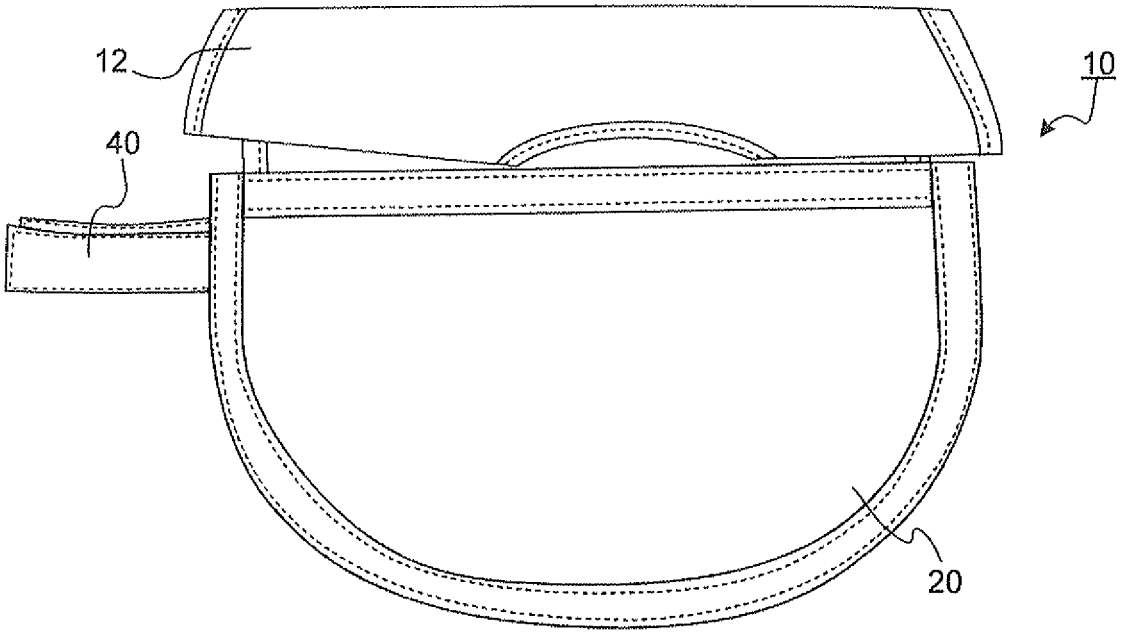
Figure 9:
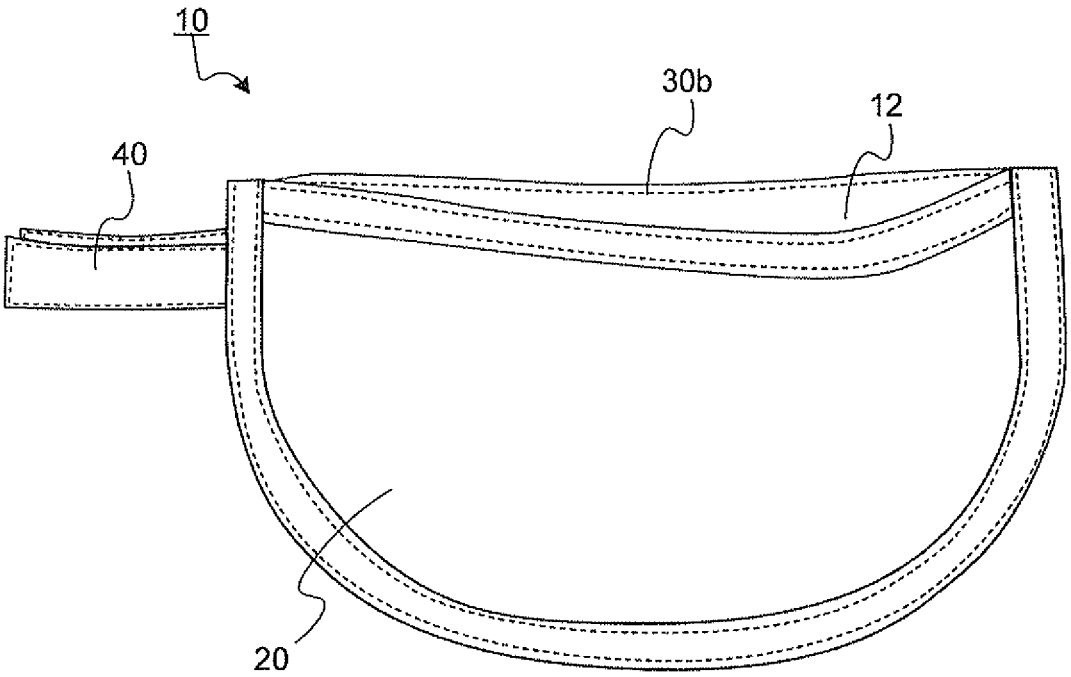

FIG. 5 shows an adjustable fastener 40. The adjustable fastener 40 can be attached to the convertible bib 10 at any suitable location. The adjustable fastener 40 can be composed of a first closure element 40*a* and a second closure element 40*b*. In use, the first closure element 40*a* faces the second closure element 40*b* for adjustable attachment purposes. The adjustable fastener 40 can securely attach the convertible bib 10 to another object, such as an infant carrier, a stroller, a belt loop and/or any other object intended to carry the convertible bib 10.

FIG. 5 shows an exemplary configuration of use for the convertible bib 10. That is, the convertible bib 10 is secured around the infant's neck such that the pocket 21 opens outwardly from the front of the convertible bib 10 and acts as a tap to catch any spillage of food or liquid or during mealtime that would otherwise fall into the infants lap during meal time. As shown, the front panel 22 is slightly opened forward.

After mealtime has been completed, the convertible bib 10 can be folded downward and placed into the storage container 20. Although not shown, it is contemplated that the storage container 20 can include one or more dividers.

FIGS. 6-12 depict the folding and storage of the first panel 12 of the convertible bib 10 into the storage container 20. In more detail, in FIGS. 6-9, the first panel 12 of the convertible bib 10 is shown incrementally folded over and placed into the storage container 20 of the convertible bib 10.

Figure 10:
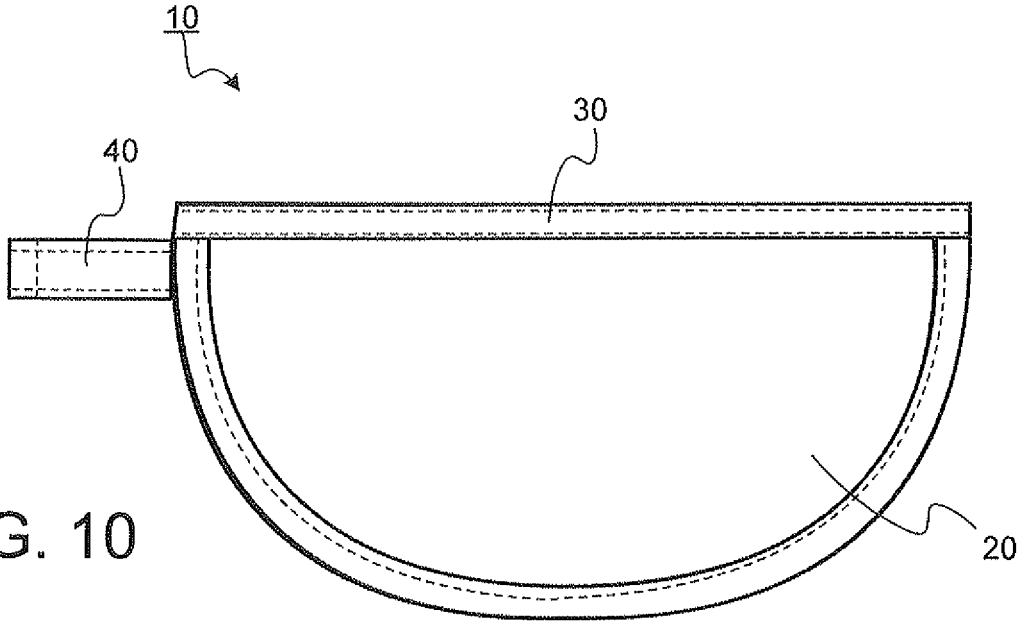
Figure 11:
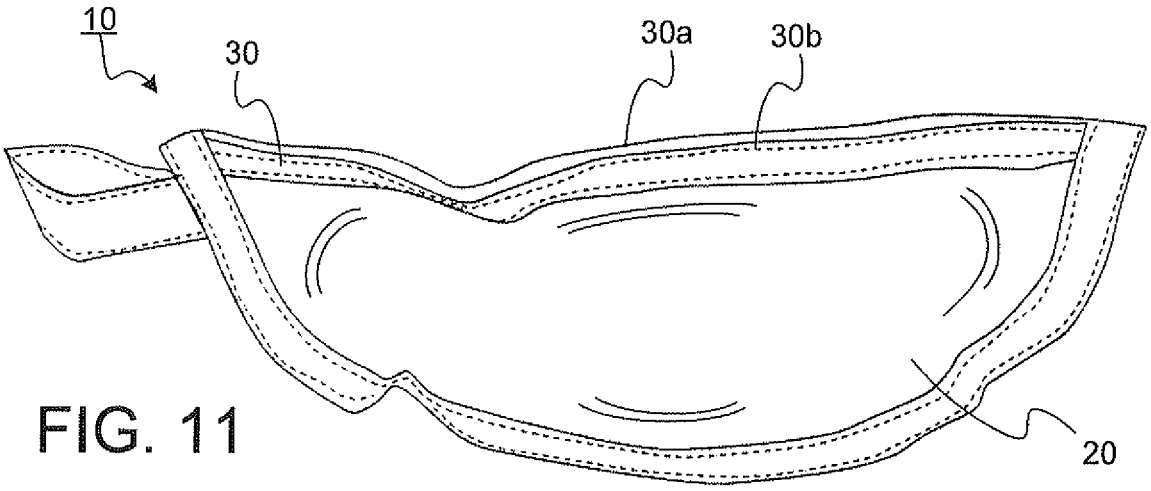
Figure 12:
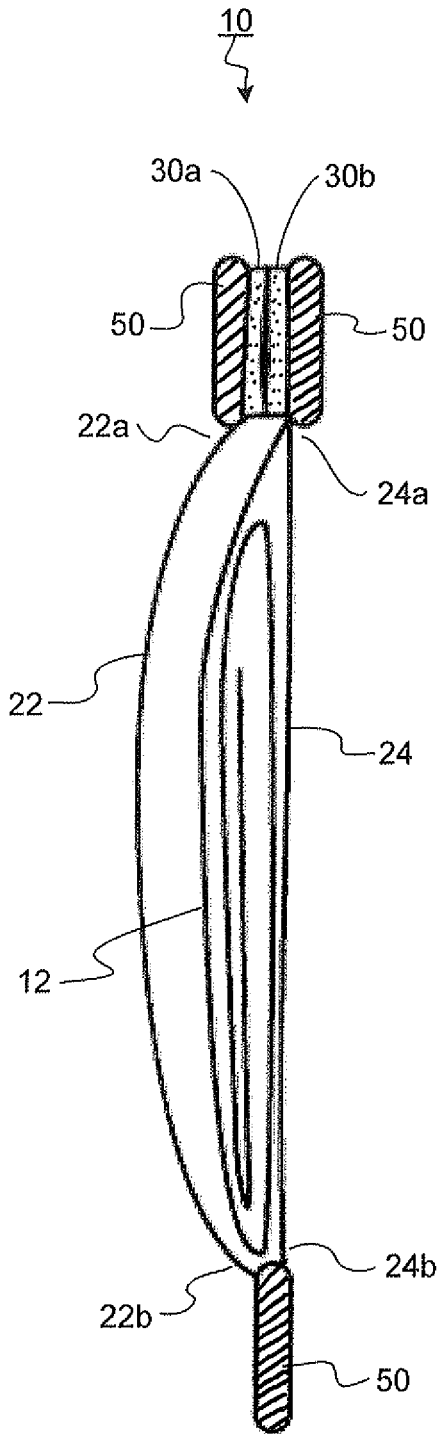
FIG. 12 illustrates a partial cross section view of the storage container of the bib.

In FIGS. 10-12, the storage container 20 is shown secured closed. That is, the first and second closure elements 30*a* and 30*b* of the second closure device 30 are shown secured closed thereby preventing the contents within the pocket 21 from falling out of the storage container 20. FIG. 12 shows a partial cross section of the first panel 12 folded and stored within the storage container 20.

Figure 13:
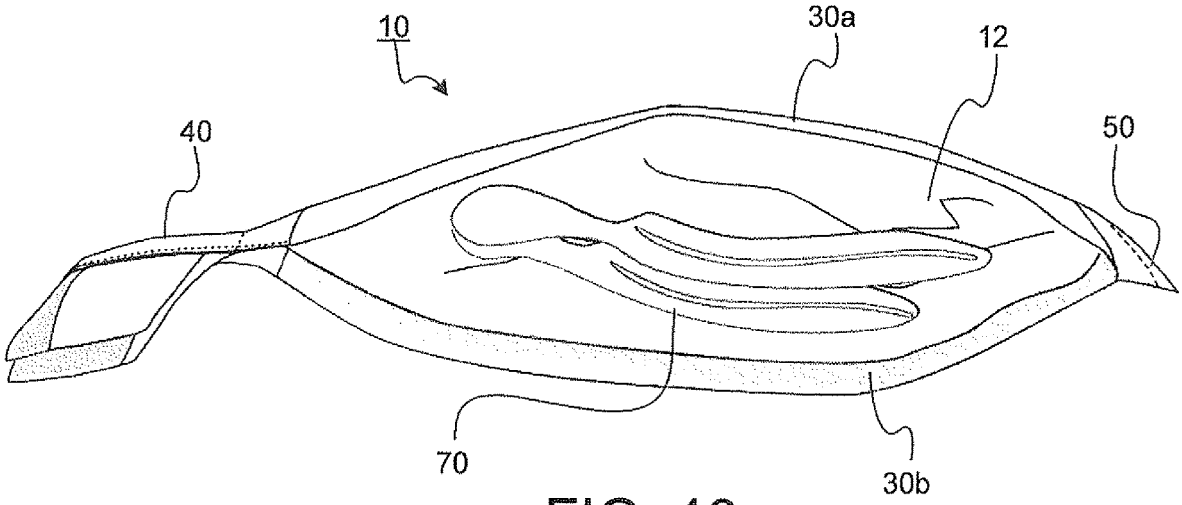
FIGS. 13-14 depict the storage container including another item for storage in addition to the first panel
Figure 14:
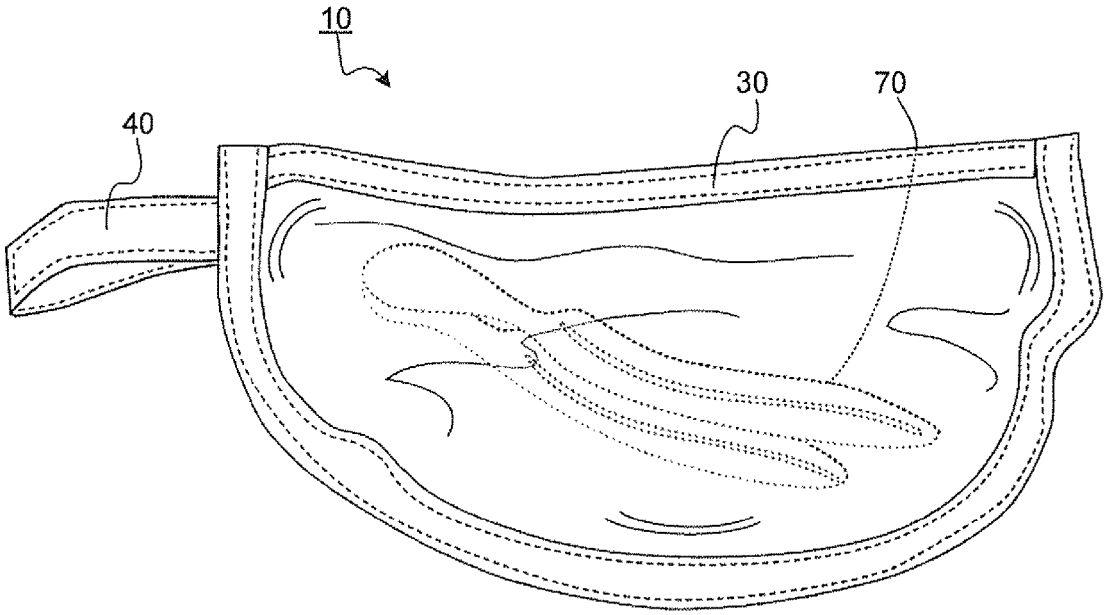

FIGS. 13-14 further demonstrate that various other items 70 may be conveniently stored and secured within the pocket 21 in addition to the first panel 12, such as spoons, snacks, toys, juices or the like.

The bib is constructed to be easily cleaned. At a suitable location, such as a wash basin, the convertible bib 10 can be opened and conveniently washed and made ready for its next use. The advantage of the convertible bib 10 is in its ability to catch spillage and to keep the infant's clothing clean and protected. The convertible bib 10 may designed aesthetically pleasing and fashionable.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

The invention claimed is:

1. A bib comprising:

a first panel and a storage container;

the first panel having an outer perimeter defining two sides and attached to the storage container, the outer perimeter of the first panel extending continuously upwards to define a collar constructed in a first end, the collar adapted to receive a neck of a user;

the storage container having a first side and a second side with reinforced seams along their respective peripheries, and an upper opening along a top edge of the first side and second side and a lower closed end, wherein a second end of the first panel is attached to the top edge of the second side of the storage container to capture spillage while in use; and a fastener disposed along an inner perimeter of the top edge of the upper opening of the storage container, the fastener having a first and second closure element, wherein the first closure element is disposed on an inside of the storage container on the first side and the second closure element is disposed on an inside of the storage container on the second side, wherein the first panel and the storage container are composed of a substantially similar material and the first panel can be folded down into the storage container and secured by the fastener.

2. The bib as recited in claim 1, wherein the collar includes two sub-collar portions.

3. The bib as recited in claim 1, wherein the first closure element is disposed along the top edge of the first side of the storage container and the second closure element is disposed along the top edge of the second side of the storage container.

4. The bib as recited in claim 3, wherein when the first panel is in an unstored position, the first panel is disposed between the first and second closure elements.

5. The bib as recited in claim 3, wherein when the first panel is in an unstored position, the first panel covers the second closure element.

6. The bib as recited in claim 1, wherein the first side is secured to the second side by the reinforced seams along the lower closed end.

7. The bib as recited in claim 1, further comprising an adjustable attachment fastener secured to one of the first panel and the storage container, the adjustable attachment fastener adapted to attach the bib to another object.

8. A convertible bib, comprising:

a storage container and a first panel;

the storage container having a front panel, rear panel, an upper opening along a top edge of the front panel and the rear panel and a lower closed end, wherein the front panel and rear panel have reinforced seams along their respective peripheries;

a closure device having a first and second closure element, the first closure element disposed on an inner perimeter of the top edge of the storage container at an upper end of the front panel and the second closure element disposed on the inner perimeter of the top edge of the storage container at an upper end of the rear panel, such that the first closure element attaches to the second closure element when the storage container is in a closed position, wherein the first closure element faces the second closure element when the storage container is in an open position; and the first panel having a first and second end and an outer perimeter, the outer perimeter of the first panel extending continuously upwards to define an adjustable collar and the second end attached to the upper end of the rear panel of the storage container below the second closure element, the adjustable collar adapted to receive a neck of a user, wherein the first panel and the storage container are composed of a substantially flexible material.

9. The convertible bib as recited in claim 8, further comprising an adjustable attachment fastener secured to one of the first panel and the storage container, the adjustable attachment fastener adapted to attach the convertible bib to another object.

10. The convertible bib as recited in claim 8, wherein the adjustable collar includes a first and second sub-collar portion and a collar closure device having a first and second mating fastening portions disposed at a top of the first and second sub-collar portion respectively.

11. The convertible bib as recited in claim 8, wherein the first closure element is disposed on an inside surface of the front panel and the second closure element is disposed on an inside surface of the rear panel when the storage container is in the open position.

12. A convertible bib, comprising:

a first panel and a storage container;

the first panel having an outer perimeter extending continuously upwards to define a collar constructed in a first end, the collar adapted to receive a neck of a user;

the storage container having a front panel, a rear panel, and an upper opening along a top edge of the front panel and the rear panel and a lower closed end, wherein a second end of the first panel is permanently attached to the top edge of the rear panel of the storage container to capture spillage while in use and wherein the front panel and the rear panel have reinforcing seams; and a closure device disposed at an inner perimeter of the top edge of the upper opening of the storage container, the closure device having a first and second closure element, wherein the first closure element is disposed on an inside of the storage container on the front panel and the second closure element is disposed on an inside of the storage container on the rear panel, and wherein the first panel can be folded down into the storage container and secured by the closure device.

13. The convertible bib as recited in claim 12, wherein the reinforcing seams of the front panel and the rear panel are along their respective peripheries, the first closure element being disposed on an inside of the storage container along an upper seam of the front panel and the second closure element being disposed on the inside of the storage container along an upper seam of the rear panel.

14. The convertible bib as recited in claim 12, further comprising an adjustable attachment fastener secured to one of the first panel and the storage container, the adjustable attachment fastener adapted to attach the convertible bib to another object.

15. The convertible bib as recited in claim 12, wherein the first panel is disposed between the first and second closure elements.

16. The convertible bib as recited in claim 15, wherein the first and second closure elements are disposed between the front panel and rear panel.

* * * * *